US008414209B2

(12) United States Patent
Forrey

(10) Patent No.: US 8,414,209 B2
(45) Date of Patent: Apr. 9, 2013

(54) LIP BALM, COSMETIC OR PERSONAL CARE PRODUCT DISPENSER UTILIZING A NON-LETHAL SHOTGUN SHELL HULL AND MODIFIED PRIMER

(76) Inventor: Wayne Stanley Forrey, Boise, ID (US)

( * ) Notice: Subject to any disclaimer, the term of this patent is extended or adjusted under 35 U.S.C. 154(b) by 77 days.

(21) Appl. No.: 13/207,329

(22) Filed: Aug. 10, 2011

(65) Prior Publication Data

US 2012/0039657 A1 Feb. 16, 2012

Related U.S. Application Data

(60) Provisional application No. 61/372,478, filed on Aug. 11, 2010.

(51) Int. Cl.
*B43K 25/00* (2006.01)

(52) U.S. Cl. ..... 401/52; 401/88; 401/75

(58) Field of Classification Search ..... 401/88, 401/195, 52, 68, 75, 78, 175; 206/385
See application file for complete search history.

(56) References Cited

U.S. PATENT DOCUMENTS

| | | | | |
|---|---|---|---|---|
| 4,166,474 | A * | 9/1979 | McArdle et al. | 401/79 |
| 6,099,873 | A * | 8/2000 | Coleman et al. | 426/90 |
| 6,457,223 | B1 * | 10/2002 | Breton et al. | 29/417 |
| 2009/0032424 | A1 * | 2/2009 | McLaughlin | 206/385 |
| 2010/0046209 | A1 * | 2/2010 | Helenowski | 362/109 |
| 2010/0078344 | A1 * | 4/2010 | Martins et al. | 206/385 |

* cited by examiner

*Primary Examiner* — David Walczak

(57) ABSTRACT

A new lip balm, cosmetic, or personal care product dispenser using a non-lethal shotgun shell hull that will accept an industry standard 0.15 ounce twist-base balm dispenser, providing increased turning friction and a tighter fitting cap. A new type of lip balm dispenser that solves the problems associated with old standard tubular balm dispensers. Standard 0.15 ounce lip balm tubes have a knurled twist base that inadvertently rotates in your jacket or pants pocket while people are engaged in outdoor activities such as walking, working, biking, hiking, hunting or fishing. As the tube base twists inside your pocket, the balm itself is wormed outward and mashed into the cap, creating a gooey mess. Also, standard lip balm tube caps come off easily in your pocket which is another big messy problem. The newly invented dispenser prevents a gooey mess in your pocket, purse, jacket or luggage.

12 Claims, 1 Drawing Sheet

Exploded View

Cross Section View

Exploded View

LIP BALM, COSMETIC OR PERSONAL CARE PRODUCT DISPENSER UTILIZING A NON-LETHAL SHOTGUN SHELL HULL AND MODIFIED PRIMER

CROSS-REFERENCE TO RELATED APPLICATIONS

This application claims priority to provisional patent application Ser. No. 61/372,478, the contents of which are incorporated by record.

STATEMENT REGARDING FEDERALLY SPONSORED RESEARCH OR DEVELOPMENT

Not applicable. There is no federally sponsored research or development actions or funding associated with this invention or patent application.

REFERENCE TO SEQUENCE LISTING, A TABLE, OR A COMPUTER PROGRAM LISTING COMPACT DISC APPENDIX

Not applicable. There are no separately submitted data as part of this patent application.

BACKGROUND OF THE INVENTION

The depicted embodiment of the present invention pertains to a new type of lip balm, cosmetic, and/or personal care product dispenser that overcomes and solves the problems associated with the currently used (prior art) industry standard 0.15 ounce plastic tubular twist-base balm dispenser.

Wayne S. Forrey, the inventor of BALMSHOT®, was diagnosed with lip cancer in 1983 due to sun exposure. After lip reconstruction surgery, he began using lip balm everyday to moisturize and protect his lips. Wayne became dissatisfied with the prior art industry standard 0.15 ounce plastic tubular twist-base balm dispenser because the knurled base would unintentionally twist in his pocket while walking, working, biking, hiking or fishing. As the prior art industry standard lip balm tube twists inside your pocket, the balm itself "worms-out" and mashes into the cap, creating a gooey mess in your clothing.

While tinkering at his garage workbench one Saturday, Wayne envisioned a new type of lip balm dispenser with a tighter fitting cap and smooth turning base. His vision resulted in the present invention. Shotshells loaded with lip balm . . . not buckshot! No more unintentional twisting, no more loose caps, no more gooey mess.

Waxy cosmetic products and lip balm's are uniformly shaped into cylindrical baton shaped sticks and packaged inside an industry standard 0.15 ounce plastic tubular twist-base balm dispenser (prior art). At the top end of the prior art dispenser is a plastic cap, held to the top end of the dispenser by minimal friction. At the bottom end of the prior art dispenser is a knurled disk which can be too-easily rotated to advance or retract the cosmetic or balm product for application by the user.

The configuration of the prior art industry standard 0.15 ounce twist-base balm dispenser that is used for lip balms, cosmetics and personal care products, has two major drawbacks. First of all, the knurled disk base turns and rotates very easy. There is very little friction to prevent the knurled disk from easily rotating in your pants pocket as you walk, work or play. The prior art knurled base can unintentionally twist and rotate while the dispenser is in your pants pocket or purse, thereby advancing and mashing the balm up into the cap, causing the cap to come off and thereby wasting cosmetic or balm and soiling or damaging adjacent items with messy balm.

Secondly, the prior art balm dispenser cap comes off very easy because there is insufficient friction between the tubular body cap flange and the interior of the cap to keep the cap in place. Outdoor enthusiasts have complained for years about flimsy, messy lip balm tubes because of these major drawbacks in the prior art.

In an attempt to solve such problems, some manufacturers have placed their lip balm and/or cosmetic products in small plastic flexible tubes (like toothpaste containers) with a screw-on cap. This approach is much more expensive to manufacture and requires the cosmetic product to have a thin watery consistency in order to flow through the flexible tube and cap opening. Consumers prefer a waxy balm consistency and therefore the prior art industry standard 0.15 ounce twist-base balm dispenser is still in widespread use despite the two limitations of the prior art. It is necessary that a new type of dispenser is needed for lip balms and waxy consistency cosmetic and personal care products, so that these products can be used without unintended de-capping or unintended rotation of the balm advancement/retraction mechanism.

BRIEF SUMMARY OF THE INVENTION

The depicted embodiment of the present invention is a lip balm, cosmetic, and/or personal care product dispenser that looks and feels like a standard shotgun shell. But instead of a shotgun shell that contains a primer, gunpowder, wads or buckshot; the present invention contains an over-the-counter industry standard 0.15 ounce twist-base balm dispenser positioned inside of the shotgun shell hull. Thus, the interior components normally found within a shotgun shell are replaced with a standard twist-base lip balm dispenser in a new, more controllable configuration. This new depicted embodiment of the present invention dispenser can contain any type of lip balm, cosmetic or personal care product that the consumer chooses to purchase. Any consumer product that is packaged in the industry standard 0.15 ounce twist-base balm dispenser can be inserted into the present invention and be made to work better and more reliably.

In the depicted embodiment of the present invention, the shotgun shell primer is removed and replaced with a mechanical fastener. There is no lead, gunpowder or explosive propellant within the shotgun shell hull. Therefore, the outer envelope present invention is safe and non-lethal. The depicted embodiment of the present invention looks and feels just like a shotgun shell . . . but it is actually a new and improved dispenser for lip balms, cosmetics, and/or personal care products.

While the making and using of the embodiment of the present invention is discussed in detail in this application, it should be noted that the present invention provides many applicable inventive concepts that may be used in a wide variety of contexts and consumer products. The specific consumer products and components discussed in this application are merely illustrative of specific ways to make and use the invention and do not limit the scope of the invention.

The main objective of the depicted embodiment of the present invention is to provide a new lip balm, cosmetic, or personal care product dispenser using a non-lethal shotgun shell hull that will accept a prior art industry standard 0.15 ounce twist-base balm dispenser, thus providing increased turning friction and a tighter fitting cap so as to prevent unintended rotation and subsequent advancement of the balm up into the cap resulting in a gooey mess, de-capping and wasted balm and ruined clothing. Another objective of the present invention is to provide an outer envelope dispenser package that will manipulate and control the industry standard 0.15 ounce twist-base balm dispenser, which is easy and economical to manufacture and functions efficiently.

BRIEF DESCRIPTION OF THE SEVERAL VIEWS OF THE DRAWING

The depicted embodiment of the present invention will now be described in greater detail with references to an embodiment represented in the drawing. The numbers referencing certain parts and components of the invention are uniform in both FIGS. 1 and 2 on the drawing.

FIG. 1 depicts what you would see if the new invention dispenser was cut in half from top to bottom longitudinally.

FIG. 2 shows all of the components of the present invention and what you would see if you disassembled the invention and the order of putting it back together.

FIG. 2 also shows the sequence of assembly. The screw fastener 1 is inserted into the outer envelope metallic base 2 and the plastic spacer 3. An industry standard 0.15 ounce twist-base balm dispenser 4 is inserted into the plastic spacer 3 and the outer envelope metallic base 2 and the screw 1 is fastened into a pre-drilled pilot hole in the bottom end of the industry standard 0.15 ounce twist-base balm dispenser 4 where the knurled disk is located. This pilot hole is located in the center of the bottom knurled disk on dispenser 4 as shown on FIG. 1. The industry standard 0.15 ounce twist-base balm dispenser 4 contains a thin plastic film spacer 5 wrapped around the tubular circumference. The industry standard 0.15 ounce twist-base balm dispenser 4 is then pushed inside of the outer envelope 7 which is the plastic hull portion of the shotgun shell.

Figure 1:
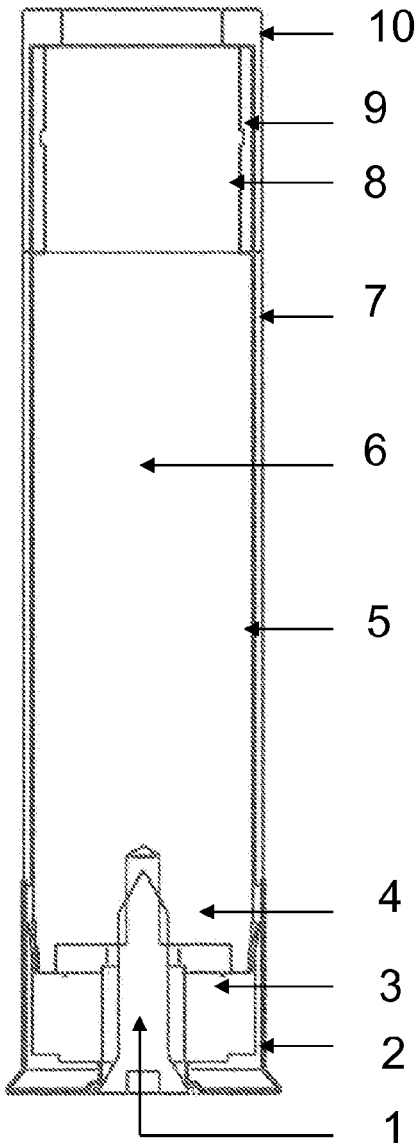
FIG. 1 is a cross section view of the outer envelope package with an industry standard 0.15 ounce twist-base balm dispenser incorporated and inserted into the present invention.
Figure 2:
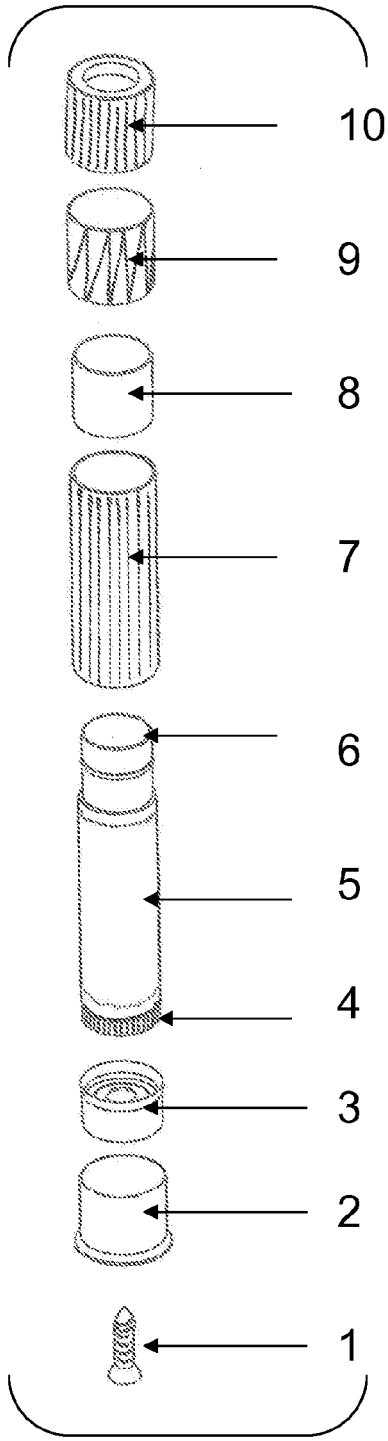
FIG. 2 is an exploded view within the brackets showing the outer envelope package with an industry standard 0.15 ounce twist-base balm dispenser incorporated and inserted into the present invention.

The balm, cosmetic or personal care product 6 is inside of the industry standard 0.15 ounce twist-base balm dispenser 4. As the user grips and holds the outer envelope 7 and rotates the base 2, the lip balm, cosmetic or personal care product 6 is advanced or retracted within the dispenser 4. To protect the lip balm, cosmetic or personal care product 6, the inner cap 8, is placed on the top flange of the dispenser 4. A thin plastic film spacer 9 is placed on the top and exterior sides of the inner cap 8 and folded over and around the inner cap 8.

A portion of shotgun shell hull tubing is then roll crimped to form an outer cap 10. The crimped outer envelope cap 10 is placed over the top of the plastic film spacer 9 and inner cap 8 and pushed downward toward the outer envelope body 7. The bottom edge of the outer envelope cap 10 is aligned to the same elevation as the inner cap 8. The inner cap 8, and the plastic film spacer 9, and outer cap 10 rest on the top flange of dispenser 4 in the same position and fashion. The new invention is now fully assembled and ready to use.

It is important to note that the prior art industry standard 0.15 ounce twist-base balm dispenser 4 remains unchanged; other than drilling a small pilot hole in the base to facilitate the fastener 1 and the addition of a wrap-around thin plastic film spacer 5. However, the wrap-around product labels that are already on the industry standard 0.15 ounce twist-base balm dispenser functions as the thin plastic film spacer 5. Thus the only physical modification to the prior art industry standard 0.15 ounce twist-base balm dispenser 4 is drilling a small pilot hole in the base to facilitate the fastener 1.

By inserting a prior art industry standard 0.15 ounce twist-base balm dispenser into the outer envelope invention, a much better and more controllable lip balm, and cosmetic or personal care product twist-base balm dispenser is achieved.

DETAILED DESCRIPTION OF THE INVENTION

The depicted embodiment of the present invention constitutes an outer envelope package that accepts the industry standard 0.15 ounce twist-base balm dispenser used for lip balms and waxy consistency cosmetic or personal care products, so that these products can be used without unintended de-capping or unintended rotation of the twist-base advancement/retraction mechanism.

The depicted embodiment of the present invention includes ten components as follows:

1. A metallic flat head square drive size #6, ⅝ inch long tapping screw 1 which replicates the look of a shotgun shell primer and provides a fastening function.
2. A metallic material base 2 which is the brass-looking base of a shotgun shell hull.
3. A plastic disk spacer 3 which is the base wad of a shotgun shell hull.
4. A plastic over-the-counter industry standard 0.15 ounce twist-base balm dispenser 4.
5. A plastic film 5 which is wrapped around the dispenser 4 and functions as a spacer to increase the diameter of the tubular dispenser 4.
6. The balm, cosmetic or personal care product 6 is inside of the industry standard 0.15 ounce twist-base balm dispenser 4.
7. The outer envelope 7 which is the plastic hull portion of the shotgun shell with customary longitudinal ridges and groves.
8. The plastic cap 8 of an industry standard 0.15 ounce twist-base balm dispenser 4 which functions as the inner cap 8.
9. A plastic film spacer 9 is placed on the top and exterior sides of the inner cap 8 and is folded over and around the inner cap 8.
10. A plastic tube roll crimped to form a cap 10 using the body of a shotgun shell hull with customary longitudinal ridges and groves.

The present outer envelope package invention has longitudinal ridges and grooves on the cap 10 and center body 7 to provide a gripping surface for easy removal of the cap 10 and convenient holding of the center portion of the outer envelope body tube 7. The metallic base 2 portion of the outer envelope has a smooth metallic surface with increased internal friction so as to prevent unintended rotation while carried in pants pocket, purse or luggage.

A small pilot hole is drilled into the center of the bottom knurled disk of an over-the-counter industry standard 0.15 ounce twist-base balm dispenser 4. (See drawing figures) An over-the-counter industry standard 0.15 ounce twist-base balm dispenser 4 with a circumference film wrap spacer 5, with lip balm, cosmetic or personal care product 6 inside the dispenser 4 is inserted inside the present outer envelope package invention. A plastic spacer disk 3, also known as a base wad, is inserted into the present outer envelope package invention where it makes contact with the outer envelope metallic base 2 and the fastener screw 1 at the bottom of the industry standard 0.15 ounce twist-base balm dispenser 4, and the inner surface of the metallic outer envelope base 2.

The fastener screw 1 is then advanced into the pilot hole in the bottom of the knurled disk on the dispenser 4 and this effectively solidifies the tubular dispenser 4 to the plastic spacer 3 and the outer envelope metallic base 2, and to the screw 1. As the outer envelope metallic base 2 holding the tubular dispenser 4 is rotated, the plastic spacer 3 and the knurled disk 4 inside the metallic outer envelope base 2 also rotates. The body of the dispenser 4, where the film spacer 5 is located does not rotate, but the knurled base of 4 does rotate as the metallic base 2 is rotated in either direction. As the metallic base 2 is rotated in either direction, the lip balm, cosmetic or personal care product 6 inside the dispenser 4 is advanced or retracted by the consumer.

The outer envelope tubular body 7 is placed over the industry standard 0.15 ounce twist-base balm dispenser 4 and pressed together under pressure to seal the inner surface of the outer envelope body 7 to the inner and outer surface of the film spacer 5 to the outer surface of the industry standard 0.15 ounce twist-base balm dispenser 4. This effectively solidifies the two cylinders together, with the balm dispenser 4 inside the outer envelope tubular body 7 with plastic spacer 5 providing holding friction between the two cylinders. By placing an outer envelope covering 7 over the dispenser 4 and wedging it into the metallic base 2, greater turning friction is created on the knurled disk base of dispenser 4. In the new invention there is increased turning friction on dispenser 4 plus no knurling on the smooth metallic base 2, thus the new invention does not catch in your clothing, pocket, purse or luggage and will not unintentionally rotate and advance the balm product . . . until the consumer makes it rotate and advance or retract by hand.

A portion of the shotgun shell hull tubing is then roll crimped to form an outer cap 10. A plastic film spacer 9 is placed over the top and exterior sides of the inner cap 8 and folded over and around the inner cap 8. The outer envelope cap 10 is placed over the spacer film 9 and inner cap 8 and pressed together under pressure to seal the inner surface of the outer envelope cap 10 and the outer surface of the industry standard 0.15 ounce twist-base balm cap 8. This effectively solidifies the two caps together, with the plastic spacer 9 providing holding friction between the two caps.

The user grips the outer envelope center body 7 with one hand, and then with the other hand removes the outer envelope cap 10. While continuing to grip the outer envelope center body 7 with one hand and holding it steady, the user then firmly rotates the outer envelope metallic base 2 to advance or retract the lip balm, cosmetic or personal care product 6. After using the lip balm, cosmetic or personal care product, the user places the outer envelope cap 10 over the exposed end of the 0.15 ounce dispenser 4 to seal the lip balm, cosmetic or personal care product. The complete outer envelope package containing the lip balm, cosmetic or personal care product can now be placed in pocket, purse or luggage as needed.

The outer envelope package invention has the same diameter as a standard shotgun shell. The outer envelope package invention has about the same length as a standard shotgun shell. The outer envelope package invention has a total assembled length of about 3.1 inches or 7.87 centimeters.

I claim:

1. A material dispenser comprising:

a dispenser having a cylindrical tube adapted to contain a material to be dispensed and a rotary disk at a lower end of said tube for dispensing the material when said rotary disk is rotated; and a shotgun shell having all explosive propellants removed therefrom for covering at least a portion of said dispenser, said shotgun shell comprising a metal base, a plastic spacer and a body tube wherein;

said metal base and said plastic spacer of said shotgun shell are secured to said rotary disk such that said rotary disk will rotate upon rotation of said metal base and wherein said body tube of said shotgun shell substantially surrounds said cylindrical tube of said dispenser such that said metal base is rotatable with respect to said body tube of said shotgun shell.

2. The dispensing case of claim 1 wherein said cylindrical tube comprises a cap configured to cap said cylindrical tube, wherein said cap of said cylindrical tube is located within a separated portion of said body tube said shotgun shell.

3. The dispensing case of claim 1 wherein said metal base of said shotgun shell is attached to said rotary disk of said dispenser by a screw.

4. The dispensing case of claim 3 wherein said screw is positioned in a location in the position a shotgun shell primer would be positioned in a shotgun shell.

5. The dispensing case of claim 1 wherein said material dispenser is configured such that a force required to rotate said metal base of said shotgun shell case is greater than the amount of force required to rotate said rotary disk of said dispenser.

6. The dispensing case of claim 1 wherein said body tube of said shotgun shell comprises a crimped end.

7. The dispensing case of claim 1 wherein said shotgun shell metal base comprises steel.

8. The dispensing case of claim 1 wherein said shotgun shell comprises a high base shotgun shell.

9. The dispensing case of claim 1 wherein said shotgun shell comprises a low base shotgun shell.

10. The dispensing case of claim 1 wherein said cylindrical tube is configured to hold 0.15 ounces of said selected material.

11. The dispensing case of claim 1 wherein said shotgun shell comprises a twenty gauge shotgun shell.

12. The dispensing case of claim 1 wherein said metal base of a shotgun shell is attached to said rotary disk of said dispenser by a mechanical fastener.

* * * * *